US006740479B2

(12) United States Patent
Loccufier et al.

(10) Patent No.: US 6,740,479 B2
(45) Date of Patent: May 25, 2004

(54) SILVER HALIDE PHOTOGRAPHIC PROCESSING SOLUTION

(75) Inventors: Johan Loccufier, Zwijnaarde (BE); Frank Louwet, Diepenbeek (BE); André Roefs, Herentals (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/617,647

(22) Filed: Jul. 11, 2003

(65) Prior Publication Data

US 2004/0023169 A1 Feb. 5, 2004

Related U.S. Application Data

(60) Provisional application No. 60/402,991, filed on Aug. 13, 2002.

(30) Foreign Application Priority Data

Jul. 30, 2002 (EP) ..... 02102068

(51) Int. Cl.[7] ..... G03E 5/305
(52) U.S. Cl. ..... 430/488
(58) Field of Search ..... 430/488

(56) References Cited

U.S. PATENT DOCUMENTS 3,326,977 A 6/1967 Johnson et al. ..... 260/584

FOREIGN PATENT DOCUMENTS

| | | |
|---|---|---|
| EP | 0 621 506 | 10/1994 |
| EP | 1 104 893 | 6/2000 |
| EP | 1 061 413 | 12/2000 |
| GB | 1225406 | 3/1971 |

OTHER PUBLICATIONS

European search Report, EP 02 10 2068, Jan. 13, 2003.

*Primary Examiner*—Hoa Van Le
(74) *Attorney, Agent, or Firm*—Joseph T. Guy; Nexsen Pruet, LLC

(57) ABSTRACT

A silver halide photographic processing solution comprising at least one polymeric compound inhibiting sludge formation and preventing "pi-line" artefact, more particularly in radiographic non-destructive testing applications, wherein said polymeric compound comprises at least one monomer unit having a silver complexing moiety and at least one monomer unit having a solubilizing group, and wherein both said silver ion complexing moiety and said solubilizing group are comprised in same or different monomer units.

40 Claims, No Drawings

SILVER HALIDE PHOTOGRAPHIC PROCESSING SOLUTION

This Application claims benefit of 60/402,991 filed Aug. 13, 2002.

FIELD OF THE INVENTION

The present invention relates to a solution for sludge formation and "pi-line" artefact, while processing silver halide photographic materials.

BACKGROUND OF THE INVENTION

From an ecological point of view, there is a continuous pressure on waste reduction in photographic processing.

Combined with customer demands for a more convenient processing, this results in ever decreasing replenishing rates for both developer and fixer. Sludge formation is one of the major problems when attempting to further reduce the replenishing rates and to avoid waste. Otherwise for industrial radiography wherein in a normal processing cycle in an automatic processing machine use is made of film transport over racks, wherein each of said racks is provided with a lot of rollers immersed in the different processing baths, pollution by e.g. dust being carried into the processor by the film to be processed and generation of very small metallic silver particles in the developer, due to the development process, together with the evitable manipulations like arrest in development, start of the circulation of processing and regeneration liquids make the generated solid particles become deposited onto the rollers of the racks. So when a film is introduced into the processor as a first film of a whole series of films, its first contact with the first stained roller releases the deposit from the said roller or disturbs the deposited layer and as a consequence thereof, after one rotation of the said roller the unevenly distributed dirt or stain comes into contact again with the transported film surface so that it may be deposited onto said surface. The artefact described hereinbefore, recurrently repeated, not only at the first roller, but also at the further rollers that are mounted onto the racks is called "pi-line" as it is recurrently depicted at a distance corresponding with the circumference of the rollers.

A lot of compounds suitable for use as sludge preventing additives are known for developer compositions as has extensively been illustrated in the patent literature, e.g. in GB-A 2 029 037, U.S. Pat. Nos. 3,628,955; 4,169,733; 4,310,622; 4,371,610; 4,391,900; 4,546,070; 5,240,823; 5,356,761; 5,385,811; 5,518,868 ; 5,641,620; 5,707,793 and 5,840,472 as well as in EP-A's 0 136 582, 0 223 883, 0 785 467, 0 789 272, 0 851 282, 1 061 413 and 1 061 414. None of the proposed solutions can however be considered as an ultimate solution in order to avoid sludge formation in all applied conditions and even U.S. Pat. No. 5,518,868 although moreover offering a solution for the "pi-line" artefact from the side of the silver halide photographic material as well as from the side of processing solutions leaves still room for further improvements.

Same can be concluded from GB-A 1,225,406 wherein sulphonated tannin polymers act as generally known dispersing agents, suggesting to have a stabilizing effect on colloidal silver present in the developer while processing, not acting therein as a silver complexing compound due to the absence of a silver adsorbing group in its polymeric structure.

Hence, there remains a continuous need for additives for processing solutions, thereby preventing formation of sludge and "pi-line". Almost all of the additives known from the patent literature have a low molecular weight as a common property. A lot of these compounds are the result of a combination of a strong silver ion complexing group as e.g. a heteroaromatic thiol and a solubilizing group such as a sulphonate or carboxylate. These compounds are known to prevent, or at least inhibit, the reduction of silver ions in solution, to prevent the deposition of silver nanoclusters in the developer and to inactivate the catalytic activity of those potentially formed silver nanoclusters for further reduction of dissolved silver ions.

Disadvantageous however is their ability to dissolve quite a lot of silver ions from the emulsion during processing, which results in a significant increase in silver ion concentration in the developer. However above a critical concentration of silver ions in the developer those compounds, known from the state-of-the-art as "sludge preventing additives", loose their activity. In order to solve this well-known problem, components known as "dissolution regulators (inhibitors)" have been added to the developer as has clearly been illustrated in JP-A's 59-079244, 59-079250, 59-079251, 60-080839, 04-277739 and 04-333046, in EP-A 0 272 217 and in U.S. Pat. Nos. 5,300,410; 5,364,746; 5,457,011; 5,821,040; 6,238,853 and 6,238,854. Typical examples of those dissolution inhibitors are the small heterocyclic thiols without solubilizing groups. They are very effective in preventing or inhibiting dissolution of silver ions in a developer, but they are negativating the desired sensitometry as their influence on speed and developability of the processed silver halide materials is questionable. As depending on the conditions of the developer during processing both speed and developability of the developed materials is decreased to an unexpectable and almost inadmissable extent, it is extremely difficult to balance the ratio of both the sludge preventing compound and the dissolution inhibitor.

SUMMARY OF THE INVENTION

As becomes clear from the problems posed hereinbefore, it remains a stringent object to provide chemical compounds as additives avoiding formation of sludge and "pi-line" in developer compositions to a better extent than known until now.

The above-mentioned advantageous effects have been realized by providing an aqueous silver halide photographic processing solution having the specific features set out in claim 1.

Specific features for preferred embodiments of the invention are set forth in the dependent claims, while further advantages and embodiments of the present invention will become apparent from the following description.

DETAILED DESCRIPTION OF THE INVENTION

It has now unexpectedly been found that selected polymeric compounds are very effective in preventing sludge, without negatively influencing (increasing) the dissolution rate of the silver halide and/or (decreasing) developability or speed of photographic materials, when making use therefrom in their processing cycle.

The selected polymeric compounds preventing sludge formation, particularly suitable for use in processing solutions according to the present invention therefore comprise at least one monomer unit having a silver ion completing moiety and at least one monomer unit having a solubilizing group. The group complexing silver ions and the solubilizing group are, in a particular embodiment, comprised in the same monomer unit. In a preferred embodiment according to the present invention the processing solution comprises as an additive a polymeric compound having a thiol or a salt thereof as a group complexing silver ions, a group capable of generating a thiol by hydrolysis or a disulfide. By providing such polymeric compounds having a specific silver affinity reduction of silver ions becomes suppressed or inhibited, and, if colloidal silver would be generated, to stabilize the said silver in dispersed form, further thereby passivating the silver nuclei in order to avoid growth thereof and deposit of mud.

In a further preferred embodiment, the solubilizing group is selected from the group consisting of a carboxylic acid or salt thereof, a sulfonic acid or salt thereof, a phosphonic acid or salt thereof, a phosphate and a sulfate. Moreover it has been shown that non-ionic groups like in (meth)acrylamides and hydrofunctional polymers are very useful additives.

Polymeric compounds suitable for use as "anti-sludging" additives in the processing solution according to the present invention can be prepared according to any known polymerisation technique, such as radical polymerisation of ethylenically unsatured monomers, polycondensates for the preparations of e.g. polyesters, polyurethanes and polycarbonates and polymers obtained by anionic or cationic ringopening polymerisations.

Also modifications (polymer analogue reactions) have been shown to offer interesting perspectives in order to reach the objects of the present invention: so e.g. polyvinyl alcohol, polyasparic acid, and polyacrylic acid (without however being limited thereto) can be functionalized with Ag-complexing groups.

In a preferred embodiment the polymeric compound comprises at least one ethylenically unsatured monomer according to formula I.

formula I

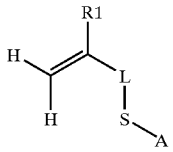

wherein:

$R^1$ is selected from the group consisting a hydrogen, a substituted or unsubstituted alkyl group, a substituted or unsubstituted aryl group or a substituted or unsubstituted heteroaryl group L is a divalent linking group A is selected from the group consisting of a hydrogen, a metallic or organic counterion or a group capable of generating a thiol upon hydrolysis.

In a most preferred embodiment the ethylenically unsatured monomer according to the formula I is selected from the group consisting of acrylates, methacrylates, acrylamides, methacrylamides, vinylethers and styrenes.

Typical examples of monomers according to the formula I are given in the formulae I-1 to I-15 hereinafter, without however being limited thereto.

Monomer-I.1

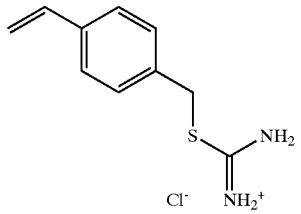

(mixture of meta- and para-isomers)

Monomer-I.2

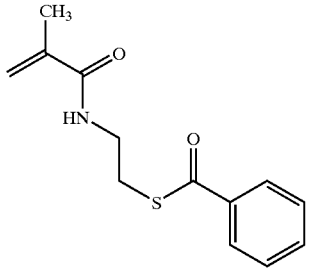

Monomer-I.3

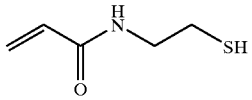

Monomer-I.4

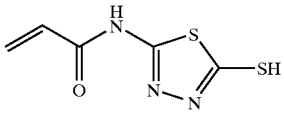

Monomer-I.5

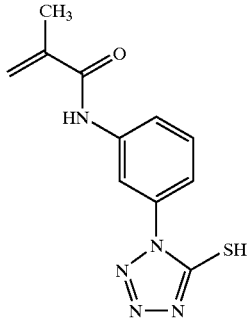

Monomer-I.6

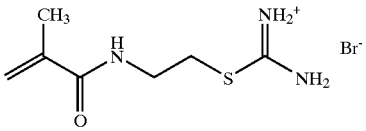

Monomer-I.7

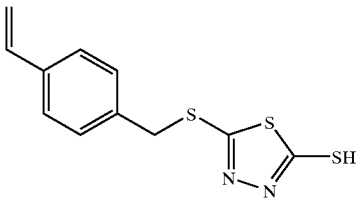

Monomer-I.8

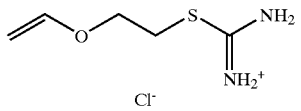

-continued

Monomer-I.9

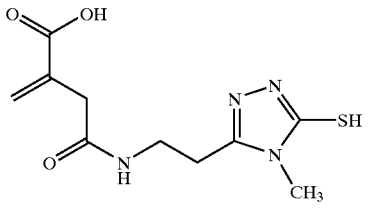

Monomer-I.10

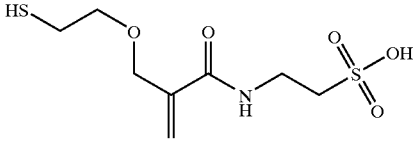

Monomer-I.11

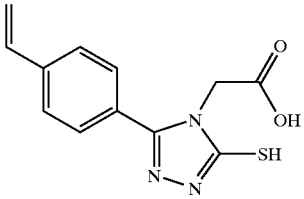

Monomer-I.12

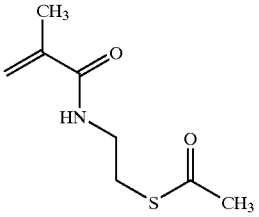

Monomer-I.13

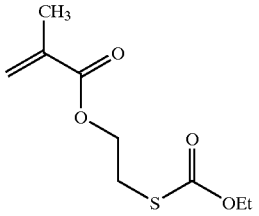

Monomer-I.14

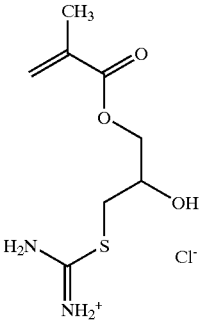

Monomer-I.15

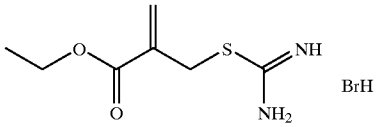

In a further preferred embodiment, the polymeric compound comprises at least one ethylenically unsatured monomer according to formula II:

formula II

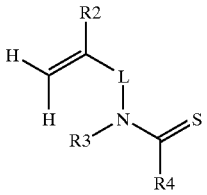

wherein:

$R^2$ is selected from the group consisting of a hydrogen, a substituted or unsubstituted alkyl group, a substituted or unsubstituted alkylene group, a substituted or unsubstituted aryl group, a substituted or unsubstituted heteroaryl group, a carboxylic acid or salt thereof, a carboxamide, an ester of a carboxylic acid, a ketone or an aldehyde;

L represents a divalent linking group $R^3$ is selected from the group consisting of a hydrogen, a substituted or unsubstituted alkyl group, a substituted or unsubstituted alkylene group, a substituted or unsubstituted aryl group, a substituted or unsubstituted heteroaryl group, CO—$R^5$;

$R^4$ is selected from the group consisting of a substituted or unsubstituted alkyl group, a substituted or unsubstituted alkylene is group, a substituted or unsubstituted aryl group, a substituted or unsubstituted heteroaryl group, $OR^6$, $SR^7$, $NR^8R^9$ $R^5$ is selected from the group consisting of a hydrogen, a substituted or unsubstituted alkyl group, a substituted or unsubstituted alkylene group, a substituted or unsubstituted aryl group, a substituted or unsubstituted heteroaryl group, $OR^6$, $SR^7$, $NR^8R^9$ $R^6$ and $R^7$ are each independently selected from the group consisting of a substituted or unsubstituted alkyl group, a substituted or unsubstituted alkylene group, a substituted or unsubstituted aryl group, a substituted or unsubstituted heteroaryl group $R^8$ and $R^9$ are each independently selected from the group consisting of a hydrogen, a substituted or unsubstituted alkyl group, a substituted or unsubstituted alkylene group, a substituted or unsubstituted aryl group, a substituted or unsubstituted heteroaryl group; and wherein further $R^8$ and $R^9$ may be combined to form a ring and $R^3$ and $R^4$ may be combined to form a ring.

Typical examples of monomers according to formula II are given in the formulae II-1 to II-10 hereinafter, without however being limited thereto.

II-1

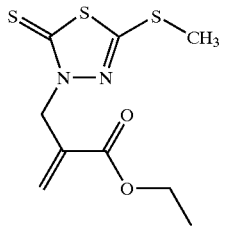

-continued

II-2

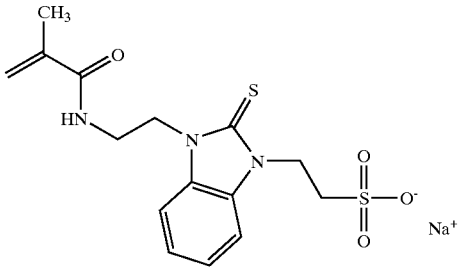

II-3

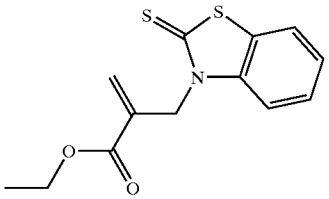

II-4

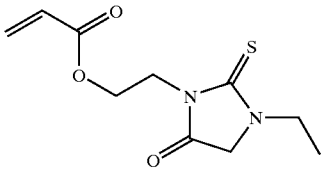

II-5

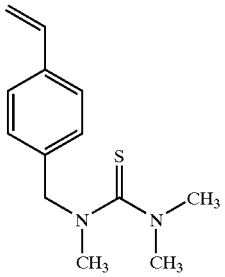

II-6

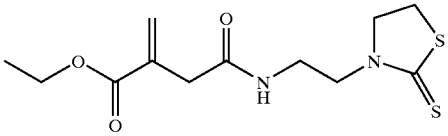

II-7

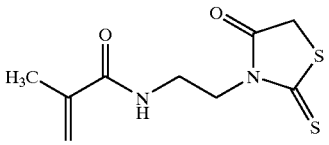

II-8

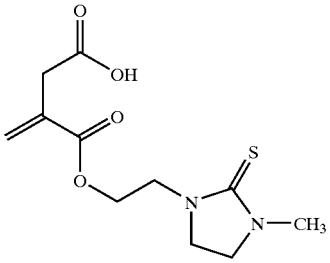

-continued

II-9

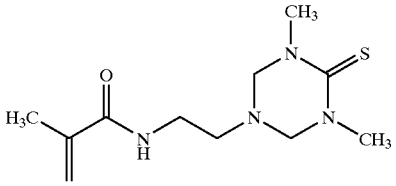

II-10

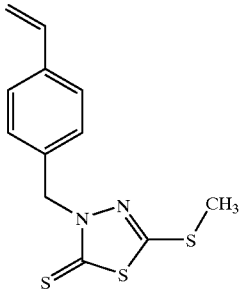

The monomers according to the general formulae I and II are preferably copolymerized with a monomer comprising at least one solubilizing group, wherein said solubilizing group is more preferably selected from the group consisting of a carboxylic acid or salt thereof, a sulfonic acid or salt thereof, a phosphonic acid or salt thereof, a phosphate or a sulfate in order to provide a polymeric compound suitable for use as an additive in the processing solution according to the present invention.

Typical monomers having a solubilizing group are acrylic acid, is methacrylic acid, styrene-4-sulfonic acid, 4-carboxymethyl-styrene, itaconic acid maleic acid, fumaric acid, 2-acrylamino-2-methylpro-pane-sulfonic acid, without however being limited thereto.

Typical examples of very suitable polymeric compounds preventing sludge formation, when added to processing solutions according to the present invention are given below, again without however being limitative:

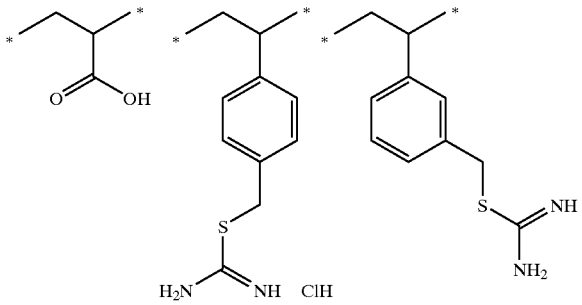

Copolymer-III.1 of acrylic acid with monomer-I.1

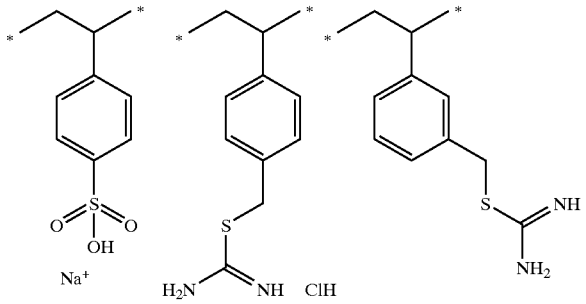

Copolymer-III.2 of styrene sulphonic acid with monomer-I.1

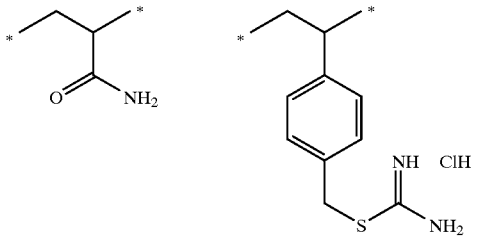

Copolymer-III.3 of acrylamide with monomer-I.1

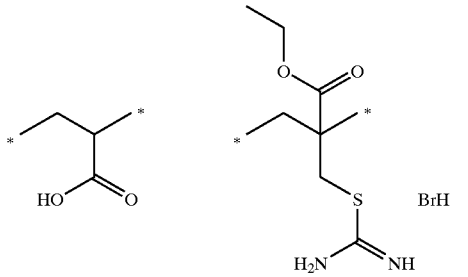

Copolymer-III.4 of acrylic acid with monomer-I.15

Copolymer-III.5 of styrene sulphonic acid with monomer-I.15

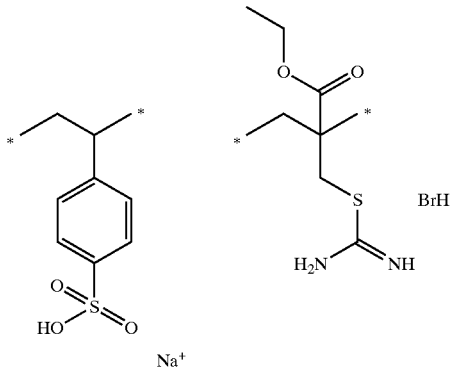

Copolymer-III.6 of acrylic acid with monomer-II.1

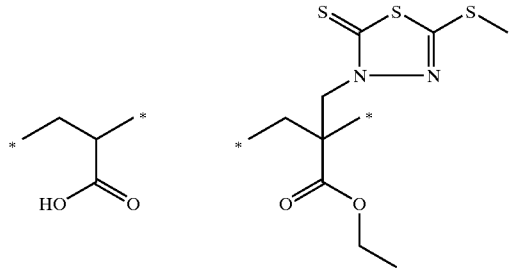

Copolymer-III.7 of styrene sulphonic acid with monomer-II.1

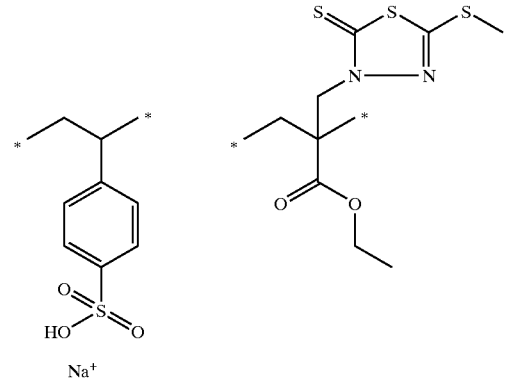

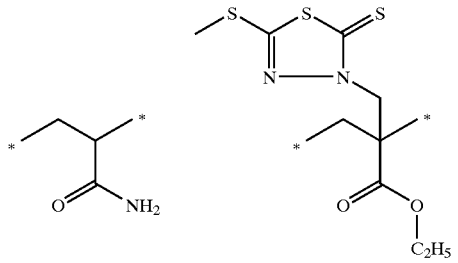

Copolymer-III.8 of acrylamide acid with monomer-II.1

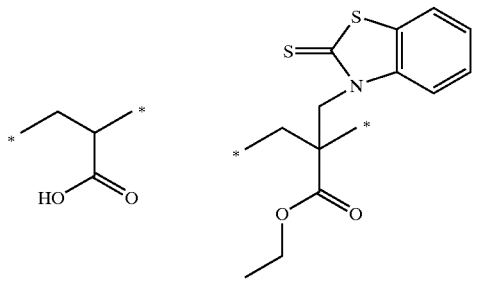

Copolymer-III.9 of acrylic acid with monomer-II.2

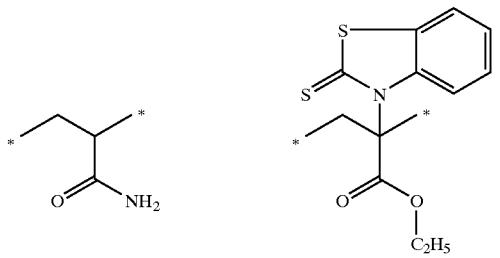

Copolymer-III-10 of acrylamide with monomer-II.2

According to the present invention the molar ratio of the monomer unit comprising a moiety having silver ion complexing ability to the monomer comprising a solubilizing group is preferably between 1 to 100 and 100 to 1, more preferably between 1 to 100 and 1 to 1 and still more preferably between 1 to 25 and 5 to 1.

The polymeric compound preventing sludge formation may further comprise other monomers besides the monomer unit comprising a silver ion complexing moiety and the monomer unit comprising a solubilizing group.

It is not very significant to discuss the ranges of the preferred molecular weight wherein the sludge preventing polymeric compound is situated: the range between relatively low molecular weights of about 1,000 and high molecular weights of about 500,000 should be considered, but methods for determining those molecular weights are prone to discussion as most of them are relative methods, offering no unambiguous standard. Moreover interactions of the polymeric chain with the experimental environment further lays burden thereupon and may lead to false interpretations of "molecular weights".

In a preferred embodiment according to the present invention the processing solution is a photographic developing solution.

Use of a processing solution according to the present invention as described in preferred embodiments in detail hereinbefore is further claimed.

It is further not excluded to make use of the polymeric compound as a coating agent in the protective antistress layers of silver halide materials to be processed. As silver halide photographic materials especially envisaged within the context of non-destructive testing applications reference is made to the materials having been coated with cubic silver halide grains as described in EP-A's 0 538 947, 0 622 668, 0 620 483, 0 620 484, 0 621 506, 0 698 817, 0 754 971 and 0 754 972 and with tabular silver halide grains as disclosed in EP-A's 0 678 772, 0 890 875, 1 195 642 and 1 197 797. The halide composition of the cubic or tabular silver halide grains coated in the radiation sensitive emulsion layers is not restricted to grains rich in silver bromide, like the silver bromoiodide grains normally used, but is also related with grains rich in silver chloride.

EXAMPLES

While the present invention will hereinafter be described in connection with preferred embodiments thereof, it will be understood that it is not intended to limit the invention to those embodiments.

The synthesis of some monomers, the structure of which has been given hereinbefore has been described hereinafter.

The synthesis of Monomer I.1

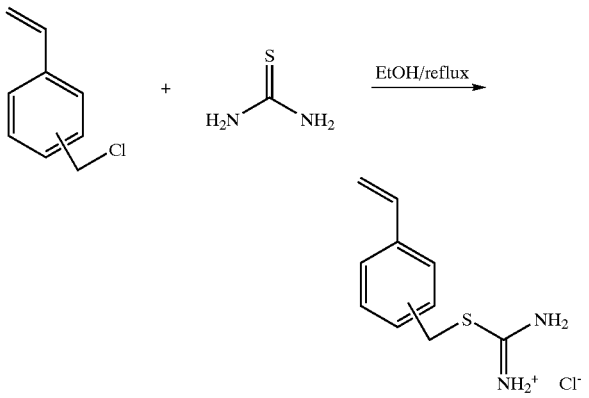

152.5 g (2.01 mole) of thioureum were suspended in 750 ml ethanol en heated to reflux. 305 g (2 moles) of vinylbenzylchloride (mixture of 3- and 4-isomers) were added dropwise while gently refluxing.

The mixture was refluxed for an additional 2 hours. After cooling down to room temperature, the reaction mixture was concentrated to 500 ml and 500 ml of ethylacetate was further added.

Monomer I.1 precipitated from the medium as a white crystalline solid. The compound was isolated by filtration, was washed twice with 500 ml ethylacetate/ethanol 3/1 and dried. 170 grams of monomer I.1 were isolated.

The Synthesis of Monomer I.15, II.1 and II.2

Preparation of Intermediate I:

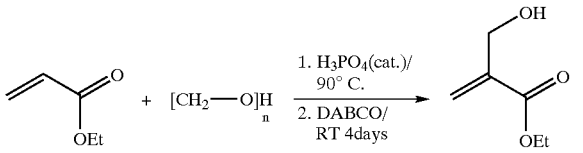

200 g of polyoxymethylene (6.7 moles) were suspended in 670 ml water. 25 ml of a 1N $H_3PO_4$ solution were added. The mixture was heated to 90° C. for 2 hours. After cooling down to room temperature, 75 g of 1,4-diaza-bicyclo[2-2-2]octane ("DABCO" in an amount of 0.67 mole) and 670 g (6.7 moles) of ethylacrylate in 670 ml of tetrahydrofuran were added and the reaction was allowed to continue at room temperature for 4 days. The residual polyoxymethylene was removed by filtration. The residual ethylacrylate and the formed hydroxymethyl ethylacrylate were separated from the mixture. The mixture was extracted twice with one liter of tert. butyl- methyl is ether. The organic fractions were pooled and dried over $MgSO_4$. 200 mg of 2,6-di-tert.-butyl-4-methylphenol were added in order to avoid polymerisation and the solvent was removed under reduced pressure. Intermediate I was finally purified by destination under reduced pressure(0.5 mm Hg). The fraction between 41° C. and 70° C. was isolated. Finally, 161 g of intermediate I were isolated.

Preparation of Intermediate II

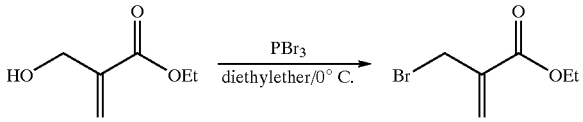

The intermediate ethyl-bromomethacrylate was prepared by dissolving 130 g (1 mole) of ethyl-hydroxymethacrylate in 1100 ml of diethyl ether. 133 g (0.49 mole) $PBr_3$ were added dropwise, while the reaction mixture was kept below 0° C. The reaction was allowed to continue for 4 hours at 0° C. After 4 hours, 1100 ml of water were added slowly, while keeping the temperature below 10° C. The organic layer was isolated and the aqueous phase was extracted three times with 250 ml hexane. The pooled organic fractions were dried over $Na_2SO_4$. 200 mg 2,6-di-tert.-butyl-4-methylphenol were added in order to avoid spontaneous polymerisation and the solvents were removed under reduced pressure. The crude product was used without further purification.

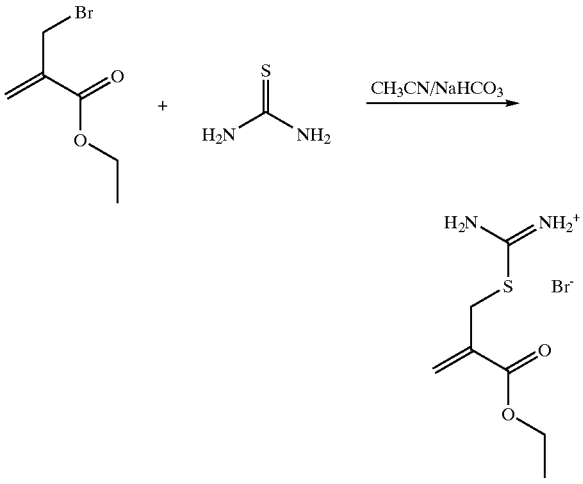

Monomer I.15

8.8 g (50 mmole) of thioureum were suspended in 100 ml of $CH_3CN$ and 4.1 g of $NaHCO_3$ (50 mmole) were added. 10.7 g (55 mmoles) of intermediate II were added dropwise and the reaction was allowed to continue over night.

Monomer I.15 precipitated from the medium as a white crystalline compound. Monomer I.15 was redissolved in 200 ml of ethanol and $NaHCO_3$ was removed by filtration.

The ethanol was evaporated under reduced pressure to 35 ml and 75 ml of ethyl acetate were added. The precipitated monomer was isolated by filtration, washed with ethyl acetate and dried.

7.1 grams of monomer I.15 were isolated.

Monomer II.1

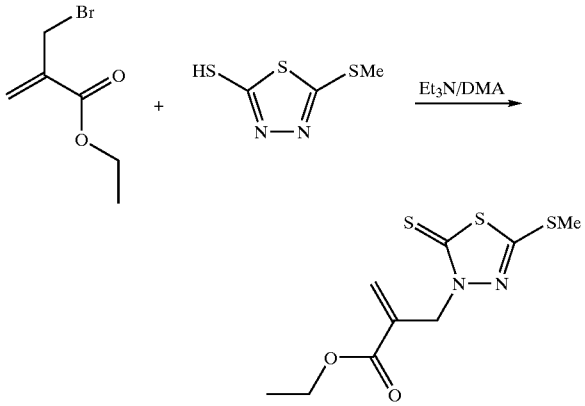

13.2 g (80 mmoles) of S-methyl mercapto-thiadiazole were dissolved in 50 ml of dimethylacetamide. 12.5 ml (80 mmoles) of triethylamine were added. A solution of 16.4 g (80 mmoles) of intermediate II in 25 ml dimethylacetamide was added dropwise over 15 minutes. The reaction was allowed to continue for 1 hour at 70° C. After cooling down to room temperature, the reaction mixture was poured out into 300 ml of water and 3 ml of acetic acid. The mixture was extracted with 300 ml of methylene chloride. The methylene chloride was washed twice with 100 ml water and dried over $MgSO_4$. The methylene chloride was evaporated under reduced pressure and monomer II.1 was isolated by preparative column chromatography on silica (hexane/methyl tert. butylether: 70/30).

Finally 17.1 grams of monomer II.1 were isolated.

Monomer II.2

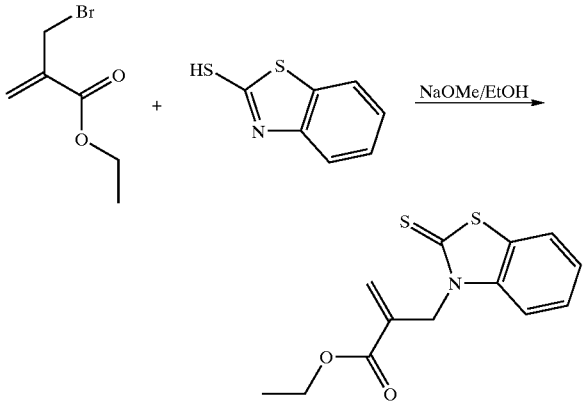

16.7 g (100 mmoles) of 2-mercaptobenzothiazole were suspended in 100 ml of ethanol. This starting product was deprotonated by the addition of 18.5 ml of a 29% sodium methanolate solution in methanol (w/v%). 23.2 g of intermediate II (120 mmoles) in 100 ml of ethanol were added dropwise. The temperature rose to 42° C. upon addition. The reaction was allowed to continue for 1 hour at 55° C. The precipitated salts were removed by filtration and the residual solvent was evaporated under reduced pressure. The residual oil was purified by preparative column chromatography on silica (eluent: hexane/ethyl-acetate: 85/15). Finally 13.1 grams of monomer II.2 were isolated.

Preparation of Copolymer-III.1 of acrylic Acid and monomer-I.1

In a 500 ml 3-neck polymerisation vessel equipped with a stirrer, a nitrogen inlet and a thermometer, 18 g of acrylic acid and 2 g of monomer-I.1 were dissolved in 176 g of deionized water. After purging for 15 minutes with nitrogen the mixture was heated to 70° C. At 70° C 0.02 g of $Na_2S_2O_8$ were added. After 7 hours the polymerisation vessel was cooled to room temperature. This was resulting in a viscous solution having a solid content of 7.11 wt %.

Example No. 1

Besides running in the developer G135® (trade name product marketed by Agfa-Gevaert), the exposed film material, the composition of which has been given hereinafter, was run in an experimental developer (comparative developer CD) having same composition as G135®, but without presence therein of the normally used anionic alkylphenoxy polyalkyleneoxy phosphate ester surfactant, further comprising as chemical agents hydroquinone, phenidone, potassium sulphite, 1-phenyl-5-mercaptotetrazole, 5-nitroindazole and glutaric dialdehyde and an inventive developer (ID) the composition of which has been given hereinafter.

Inventive Developer (ID)

To a developer solution CD (comparative developer as described above) 245 g of an aqueous solution (7.77 wt % concentrated, as determined from the dry residue) of the polymeric compound the structure of which is illustrated hereinafter were added per 4 liter of developer "ready-for-use": 0.475 g of "active product" (sulphur containing parts of the polymeric chain), corresponding with the structure of Copolymer-III.1 of acrylic acid with monomer-I.1 as given hereinbefore, were present.

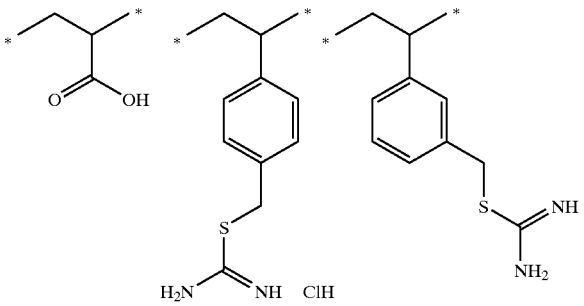

Following Film Material was run through the processing machine, said material being composed of following components:

Emulsion Preparation and Coating

A gelatino silver iodobromide X-ray emulsion comprising 99 mole % of silver bromide and 1 mole % of silver iodide was prepared in the following way. An aqueous solution containing 3 grams of ammonia was added to the reaction vessel containing 1550 ml of a 3% by weight aqueous solution of gelatin at 45° C. Into said reaction vessel a solution of 2000 ml of an aqueous 1.5 molar solution of potassium bromide and a solution of 2000 ml of an aqueous 1.5 molar solution of silver nitrate were introduced at constant rate of 86 ml/min under vigorously stirring conditions. During precipitation the pAg value was adjusted to and maintained at a value corresponding to an E.M.F. of +20 mV with reference to a silver/saturated calomel electrode. In this way homogeneous and regular silver halide grains having a crystal diameter of 0.54 μm were obtained. At the end of the precipitation step, the emulsion was coagulated by adding polystyrene sulphonic acid acting as a flocculating agent after adjustment of the pH value of the emulsion in the reaction. vessel to 3.5 with sulphuric acid. After rapid sedimentation of said silver halide emulsion the supernatant liquid was decanted. To remove the water-soluble salts from said flocculate, demineralized water of 11° C. was added under controlled stirring conditions followed by a further sedimentation and decantation. This washing procedure was repeated until the emulsion was sufficiently desalted. Thereafter the coagulum was redispersed at 45° C. in water after the addition of a sufficient amount of gelatin to obtain a ratio of gelatin to silver halide expressed as silver nitrate of 0.4.

The pH-value was adjusted to 6.5 and pAg to a value of +70 mV with reference to the silver/saturated calomel electrode.

Chemical sensitisation of said emulsion was performed by the addition of a sulphur and gold sensitizer and digestion at 50° C. to the point where the highest sensitivity was reached for a still acceptable fog level.

This emulsion was coated at both sides of a blue polyethylene terephthalate support having a thickness of 175 μm, so that per sq. m. an amount of silver halide corresponding to 14.5 g of silver nitrate and 12.3 g of gelatin were present. Before coating stabilizers such as 5-methyl-7-hydroxy-5-triazolo-[1,5-a]-pyrimidin and 1-phenyl-5-mercaptotetrazol were added to the emulsion. From a number of samples of the materials thus formed, the emulsion layers were covered at both sides with a protective layer of 1.5 grams of gelatin per square meter, which were hardened with 0.093 g of di-(vinyl-sulphonyl)-methane (DVS) per square meter.

The protective layers of material were in addition coated with a polyoxyalkylene compound in an amount of 0.042 $g/m^2$ at both sides of the film.

The coated and dried films were exposed according to ISO 7004 with a 235 kV radiation source with a copper filter of 8 mm thickness.

The exposed radiographic films were developed, fixed, rinsed and dried in an NDT-M ECO (trade name product from Agfa-Gevaert, Mortsel, Belgium) automatic machine processing cycle of 5 minutes. Development was run, at 29° C., in the reference developer G135®, in the comparative developer (CD) and in the inventive developer (ID).

Fixing occurred in fixer G335® (trade name) marketed by Agfa-Gevaert, at 29° C., which comprises aluminum sulphate, sodium sulphite, boric acid and sodium acetate.

In Table 1 hereinafter the result of visual inspections after having run differing amounts (in sq.m.) of processed film has been given, the said film having been run through the processing cycle mentioned above in developers G135®, comparative developer CD and inventive developer ID respectively.

In order to simulate severe real circumstances that might initiate pi-line defects processing of the materials was performed as follows: an amount of film was exposed to such an extent as to have a moderate density corresponding to the practically obtained average density for real samples after processing. The said amount of film was run through the processor to cause a replenishment of the processing solutions so that the said processing solutions were totally regenerated. In praxis about 10 $m^2$ per day were run through the said processing solutions and the applied (lower up to an amount of about 40%) regeneration was 550 $ml/m^2$ for the developer and 700 $ml/m^2$ for the fixer. The said procedure was started up in order to approach real working conditions wherein pi-line defects could be evaluated.

Therefore after the said working conditions were attained, unexposed sheets were run through the processor. The first ten sheets of each material were examined superposed to make an objective evaluation possible.

Figures ranging from 0 to 6 were given with the following significance for the appearance of the "pi-line" defect, in order to make a visually acceptable ranking:

6: inadmissable;

4 or 5: admissable for non-critical users who are not informed about the appearance of the defect;

2 or 3: acceptable for users who have already been confronted with the failure;

1: acceptable for critical customers;

0: no visibly detectable pi-line defect.

In Table 1 these figures are corresponding with the comments just given hereinbefore.

TABLE 1

| Processed amount of sq. m. film | Remarks | G135 ® | CD | ID |
|---|---|---|---|---|
| 0 | | 0.5 | 0.5 | 0.5 |
| 10 | | 2–3 | 2–3 | 1.5–2 |
| 25 | | 3 | 3–4 | 1.5 |
| 40 | | 3 | 6 | 1.5 |
| 43 | After 2 days | 3–4 | 6 | 1.5 |
| 53 | Over a weekend | 4 | 6 | 1.5–2 |

As can be concluded from the results given hereinbefore, the inventive developer having been provided with the "polymeric antisludge" and anti-"pi-line" compound indicated above provides a figure, after evaluation of "sludging" of the developer in the processing machine and "pi-line" occurring on the processed film material, that is clearly more stable and more acceptable than the best known developer G135®, even after quite a high number of square meters of that film material have been run through that processor over a time period of several days.

Sensitometric Evaluation

Therefor a commercially available Agfa STRUCTURIX PMC strip was used, known as Processing Monitoring Control for quality control of Structurix film systems in accordance with classification EN 584.

Controll was performed for the film material after having been run in G135 and ID respectively.

In Table 2 the figures obtained after running differing amounts of sq.m. of film are following: fog (F); densities at step wedges 4 and 8 (called "D4" and "D8" respectively), SR (sensitivity index) and CR (contrast index).

TABLE 2

| Dev./sq.m. | Fog | D4 | D8 | SR | CR |
|---|---|---|---|---|---|
| G135 ®/0 | 0.17 | 2.41 | 3.69 | 2.24 | 1.28 |
| ID/0 | 0.16 | 2.59 | 3.91 | 2.43 | 1.32 |
| G135 ®/40 | 0.17 | 2.29 | 3.51 | 2.12 | 1.22 |
| ID/40 | 0.16 | 2.43 | 3.71 | 2.27 | 1.28 |
| G135 ®/53 | 0.17 | 2.32 | 3.57 | 2.15 | 1.25 |
| ID/53 | 0.16 | 2.47 | 3.79 | 2.31 | 1.32 |

It can be concluded from the result obtained in the Table 2 that the preferred polymeric compound (Copolymer-III.1 of acrylic acid with monomer-I.1) added to the inventive developer ID is not negativating the sensitometric results obtained and that the is sensitometry is completely within the tolerances if compared with data obtained after the film has been run through the G135® developer.

Having described in detail preferred embodiments of the current invention, it will now be apparent to those skilled in the art that numerous modifications can be made therein without departing from the scope of the invention as defined in the appending claims as the above description is intended to be illustrative and not restrictive. Many embodiments will be apparent to those skilled in the art upon reading the above description. The scope of the invention should therefore be determined not with reference to the above description, but should instead be determined with reference to the appended claims, along with the full scope of equivalents to which such claims are entitled.

What is claimed is:

1. A silver halide photographic processing solution comprising at least one polymeric compound, wherein said polymeric compound comprises at least one monomer unit having a silver complexing moiety selected from the group consisting of a thiol or salt thereof, a group capable of generating a thiol by hydrolysis or a disulfide; and at least one monomer unit having a solubilizing group, and wherein both said silver ion completing moiety and said solubilizing group are comprised in same or different monomer units.

2. A processing solution according to claim 1, wherein said polymeric compound comprises at least one monomer unit having a solubilizing group selected from the group consisting of a carboxylic acid or salt thereof, a sulfonic acid or salt thereof, a phosphonic acid or salt thereof, a phosphate or a sulfate.

3. A processing solution according to claim 1, wherein the polymeric compound comprises an ethylenically unsatured monomer according to general formula I formula I

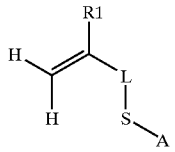

wherein $R^1$ is selected from the group consisting of hydrogen, an alkyl group, an aryl group or a heteroaryl group; L is a divalent linking group; A is selected from the group consisting of hydrogen, a metallic or organic counterion or a group capable of generating a thiol upon hydrolysis.

4. A processing solution according to claim 2, wherein the polymeric compound comprises an ethylenically unsatured monomer according to general formula I formula I

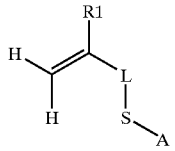

wherein $R^1$ is selected from the group consisting of hydrogen, an alkyl group, an aryl group or a heteroaryl group; L is a divalent linking group; A is selected from the group consisting of hydrogen, a metallic or organic counterion or a group capable of generating a thiol upon hydrolysis.

5. A processing solution according to claim 1, wherein the polymeric compound comprises at least one ethylenically unsatured monomer according to formula II:

formula II

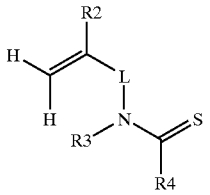

wherein:

$R^2$ is selected from the group consisting of a hydrogen, an alkyl group, an aryl group, a heteroaryl group, a carboxylic acid or salt thereof, a carboxamide, an ester of a carboxylic acid, a ketone or an aldehyde; L represents a divalent linking group; $R^3$ is selected from the group consisting of a hydrogen, an alkyl group; an aryl group, a heteroaryl group, CO—$R^5$; $R^4$ is selected from the group consisting of an alkyl group, an alkylene group, an aryl group, a heteroaryl group, $OR^6$, $SR^7$, $NR^8R^9$; $R^5$ is selected from the group consisting of a hydrogen, an alkyl group, an alkylene group, an aryl group, a heteroaryl group, $OR^6$, $SR^7$, $NR^8R^9$, $R^6$ and $R^7$ are each independently selected from the group consisting of an alkyl group, an alkylene group, an aryl group, a heteroaryl group; $R^8$ and $R^9$ are each independently selected from the group consisting of a hydrogen, an alkyl group, an alkylene group, an aryl group, a heteroaryl group; and wherein further $R^8$ and $R^9$ may be combined to form a ring as well as $R^3$ and $R^4$ may be combined to form a ring.

6. A processing solution according to claim 2, wherein the polymeric compound comprises at least one ethylenically unsatured monomer according to formula II:

formula II

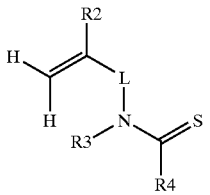

wherein:

$R^2$ is selected from the group consisting of a hydrogen, an alkyl group, an aryl group, a heteroaryl group, a carboxylic acid or salt thereof, a carboxamide, an ester of a carboxylic acid, a ketone or an aldehyde; L represents a divalent linking group; $R^3$ is selected from the group consisting of a hydrogen, an alkyl group, an aryl group, a heteroaryl group, CO—$R^5$; $R^4$ is selected from the group consisting of an alkyl group, an alkylene group, an aryl group, a heteroaryl group, $OR^6$, $SR^7$, $NR^8R^9$; $R^5$ is selected from the group consisting of a hydrogen, an alkyl group, an alkylene group, an aryl group, a heteroaryl group, $OR^6$, $SR^7$, $NR^8R^9$, $R^6$ and $R^7$ are each independently selected from the group consisting of an alkyl group, an alkylene group, an aryl group, a heteroaryl group; $R^8$ and $R^9$ are each independently selected from the group consisting of a hydrogen, an alkyl group, an alkylene group, an aryl group, a heteroaryl group; and wherein further $R^8$ and $R^9$ may be combined to form a ring as well as $R^3$ and $R^4$ may be combined to form a ring.

7. A processing solution according to claim 3, wherein the polymeric compound comprises at least one ethylenically unsatured monomer according to formula II:

formula II

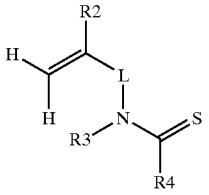

wherein:

$R^2$ is selected from the group consisting of a hydrogen, an alkyl group, an aryl group, a heteroaryl group, a carboxylic acid or salt thereof, a carboxamide, an ester of a carboxylic acid, a ketone or an aldehyde; L represents a divalent linking group; $R^3$ is selected from the group consisting of a hydrogen, an alkyl group, an aryl group, a heteroaryl group, CO—$R^5$; $R^4$ is selected from the group consisting of an alkyl group, an alkylene group, an aryl group, a heteroaryl group, $OR^6$, $SR^7$, $NR^8R^9$; $R^5$ is selected from the group consisting of a hydrogen, an alkyl group, an alkylene group, an aryl group, a heteroaryl group, $OR^5$, $SR^7$, $NR^8R^9$, $R^6$ and $R^7$ are each independently selected from the group consisting of an alkyl group, an alkylene group, an aryl group, a heteroaryl group; $R^8$ and $R^9$ are each independently selected from the group consisting of a hydrogen, an alkyl group, an alkylene group, an aryl group, a heteroaryl group; and wherein further $R^8$ and $R^9$ may be combined to form a ring as well as $R^3$ and $R^4$ may be combined to form a ring.

8. A processing solution according to claim 4, wherein the polymeric compound comprises at least one ethylenically unsatured monomer according to formula II:

formula II

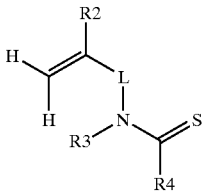

wherein:

$R^2$ is selected from the group consisting of a hydrogen, an alkyl group, an aryl group, a heteroaryl group, a carboxylic acid or salt thereof, a carboxamide, an ester of a carboxylic acid, a ketone or an aldehyde; L represents a divalent linking group; $R^3$ is selected from the group consisting of a hydrogen, an alkyl group, an aryl group, a heteroaryl group, CO—$R^5$; $R^4$ is selected from the group consisting of an alkyl group, an alkylene group, is an aryl group, a heteroaryl group, $OR^6$, $SR^7$, $NR^8R^9$; $R^5$ is selected from the group consisting of a hydrogen, an alkyl group, an alkylene group, an aryl group, a heteroaryl group, $OR^6$, $SR^7$, $NR^8R^9$, $R^6$ and $R^7$ are each independently selected from the group consisting of an alkyl group, an alkylene group, an aryl group, heteroaryl group; $R^8$ and $R^9$ are each independently selected from the group consisting of a hydrogen, an alkyl group, an alkylene group, an aryl group, a heteroaryl group; and wherein further $R^8$ and $R^9$ may be combined to form a ring as well as $R^3$ and $R^4$ may be combined to form a ring.

9. A processing solution according to claim 1, wherein a molar ratio of said monomer unit comprising a silver ion complexing moiety to said monomer unit comprising a solubilizing group is in the range between 1 to 100 and 100 to 1.

10. A processing solution according to claim 2, wherein a molar ratio of said monomer unit comprising a silver ion complexing moiety to said monomer unit comprising a solubilizing group is in the range between 1 to 100 and 100 to 1.

11. A processing solution according to claim 3, wherein a molar ratio of said monomer unit comprising a silver ion completing moiety to said monomer unit comprising a solubilizing group is in the range between 1 to 100 and 100 to 1.

12. A processing solution according to claim 4, wherein a molar ratio of said monomer unit comprising a silver ion complexing moiety to said monomer unit comprising a solubilizing group is in the range between 1 to 100 and 100 to 1.

13. A processing solution according to claim 5, wherein a molar ratio of said monomer unit comprising a silver ion complexing moiety to said monomer unit comprising a solubilizing group is in the range between 1 to 100 and 100 to 1.

14. A processing solution according to claim 6, wherein a molar ratio of said monomer unit comprising a silver ion complexing moiety to said monomer unit comprising a solubilizing group is in the range between 1 to 100 and 100 to 1.

15. A processing solution according to claim 7, wherein a molar ratio of said monomer unit comprising a silver ion complexing moiety to said monomer unit comprising a solubilizing group is in the range between 1 to 100 and 100 to 8.

16. A processing solution according to claim 8, wherein a molar ratio of said monomer unit comprising a silver ion completing moiety to said monomer unit comprising a solubilizing group is in the range between 1 to 100 and 100 to 1.

17. A processing solution according to claim 1, wherein a molar ratio of said monomer unit comprising a silver ion completing moiety to said monomer unit comprising a solubilising group is in the range between 1 to 100 and 1 to 1.

18. A processing solution according to claim 2, wherein a molar ratio of said monomer unit comprising a silver ion complexing moiety to said monomer unit comprising a solubilising group is in the range between 1 to 100 and 1 to 1.

19. A processing solution according to claim 3, wherein a molar ratio of said monomer unit comprising a silver ion complexing moiety to said monomer unit comprising a solubilising group is in the range between 1 to 100 and 1 to 1.

20. A processing solution according to claim 4, wherein a molar ratio of said monomer unit comprising a silver ion complexing moiety to said monomer unit comprising a solubilising group is in the range between 1 to 100 and 1 to 1.

21. A processing solution according to claim 5, wherein a molar ratio of said monomer unit comprising a silver ion completing moiety to said monomer unit comprising a solubilising group is in the range between 1 to 100 and 1 to 1.

22. A processing solution according to claim 6, wherein a molar ratio of said monomer unit comprising a silver ion completing moiety to said monomer unit comprising a solubilising group is in the range between 1 to 100 and 1 to 1.

23. A processing solution according to claim 7, wherein a molar ratio of said monomer unit comprising a silver ion complexing moiety to said monomer unit comprising a solubilising group is in the range between 1 to 100 and 1 to 1.

24. A processing solution according to claim 8, wherein a molar ratio of said monomer unit comprising a silver ion complexing moiety to said monomer unit comprising a solubilising group is in the range between 1 to 100 and 1 to 1.

25. A processing solution according to claim 1, wherein a molar ratio of said monomer unit comprising a silver ion complexing moiety to said monomer unit comprising a solubilizing group is in the range between 1 to 25 and 5 to 1.

26. A processing solution according to claim 2, wherein a molar ratio of said monomer unit comprising a silver ion complexing moiety to said monomer unit comprising a solubilizing group is in the range between 1 to 25 and 5 to 1.

27. A processing solution according to claim 3, wherein a molar ratio of said monomer unit comprising a silver ion complexing moiety to said monomer unit comprising a solubilizing group is in the range between 1 to 25 and 5 to 1.

28. A processing solution according to claim 4, wherein a molar ratio of said monomer unit comprising a silver ion complexing moiety to said monomer unit comprising a solubilizing group is in the range between 1 to 25 and 5 to 1.

29. A processing solution according to claim 5, wherein a molar ratio of said monomer unit comprising a silver ion complexing moiety to said monomer unit comprising a solubilizing group is in the range between 1 to 25 and 5 to 1.

30. A processing solution according to claim 6, wherein a molar ratio of said monomer unit comprising a silver ion complexing moiety to said monomer unit comprising a solubilizing group is in the range between 1 to 25 and 5 to 1.

31. A processing solution according to claim 7, wherein a molar ratio of said monomer unit comprising a silver ion complexing moiety to said monomer unit comprising a solubilizing group is in the range between 1 to 25 and 5 to 1.

32. A processing solution according to claim 8, wherein a molar ratio of said monomer unit comprising a silver ion complexing moiety to said monomer unit comprising a solubilizing group is in the range between 1 to 25 and 5 to 1.

33. A processing solution according to claim 1, wherein said processing solution is a photographic developing solution.

34. A processing solution according to claim 2, wherein said processing solution is a photographic developing solution.

35. A processing solution according to claim 3, wherein said processing solution is a photographic developing solution.

36. A processing solution according to claim 4, wherein said processing solution is a photographic developing solution.

37. A processing solution according to claim 5, wherein said processing solution is a photographic developing solution.

38. A processing solution according to claim 6, wherein said processing solution is a photographic developing solution.

39. A processing solution according to claim 7, wherein said processing solution is a photographic developing solution.

40. A processing solution according to claim 8, wherein said processing solution is a photographic developing solution.

* * * * *